United States Patent [19]

Hidding

[11] 4,078,700

[45] Mar. 14, 1978

[54] DRIPLESS POURING SPOUT AND CLOSURE CAP THEREFOR

[76] Inventor: Walter E. Hidding, Rte. No. 2, Woodrock Rd., Barrington Hills, Ill. 60010

[21] Appl. No.: 494,555

[22] Filed: Aug. 5, 1974

[51] Int. Cl.[2] ..... B65D 25/42

[52] U.S. Cl. ..... 222/109; 222/571; 264/295

[58] Field of Search ..... 222/108, 109, 571; 264/295

[56] References Cited

U.S. PATENT DOCUMENTS

| | | | |
|---|---|---|---|
| 1,749,253 | 3/1930 | Levy | 222/109 |
| 2,343,238 | 3/1944 | Manning et al. | 264/295 |
| 2,601,039 | 6/1952 | Livingstone | 222/109 |
| 2,915,223 | 12/1959 | Beall | 222/109 |
| 3,833,150 | 9/1974 | Visset-Patings | 222/109 |

FOREIGN PATENT DOCUMENTS

| | | |
|---|---|---|
| 7,108,244 | 6/1974 | Netherlands. |

*Primary Examiner*—Robert B. Reeves
*Assistant Examiner*—H. Grant Skaggs
*Attorney, Agent, or Firm*—Olson, Trexler, Wolters, Bushnell & Fosse, Ltd.

[57] ABSTRACT

A pouring spout member that is arranged for assembly to the mouth of the container includes a tubular spout and an initially longitudinally extending, anti-drip finger. A cooperating closure cap member deformably engages the anti-drip finger upon assembly with the pouring spout member to convert the finger to its use position.

1 Claim, 3 Drawing Figures

DRIPLESS POURING SPOUT AND CLOSURE CAP THEREFOR

BACKGROUND OF THE INVENTION

This invention relates generally to pouring spouts and more particularly to pouring spouts that incorporate a droplet-retention structure.

Thick or viscous household products such as salad oil, syrup, honey and the like, are difficult to pour cleanly from ordinary containers; and in the past, various devices and specially adapted containers have been suggested to obtain anti-drip properties and prevent the accumulation of undesirable, sticky deposits on outside container surfaces. One prior art type of pouring spout adapted to be installed on a bottle is shown in U.S. Pat. No. 1,749,253 whereas a specially adapted pitcher is described in U.S. Pat. No. 15,128. The antidrip pouring spouts of the prior art, however, have generally required spaced lips, one overlying the other to convey terminal droplets of liquid back into the container. Such constructions have frustrated the economical manufacture of the spouts, as for example in a plastic injection molding operation.

It is therefore an important object of the present invention to provide a dripless pouring spout and cooperative closure cap therefore which are arranged for rapid, economical manufacture from thermoplastic resinous material.

A more general object of the present invention is to provide a new and improved dripless spout construction.

Another object of the invention is to provide a dripless pouring spout and closure cap combination which have a self-cleaning action on re-assembly.

Still another object of the invention is to provide a dripless pouring spout and closure cap construction which protects the container contents against spillage.

A further object of the invention is to provide a dripless pouring spout and closure cap combination in which the anti-drip element is caused to take permanent deformation from an as-molded condition to the use position on assembly of the spout and cap, for example, after filling of the cooperating bottle or container and subsequent storing of the same.

These and other objects and features of the invention will become more apparent from a consideration of the following descriptions.

BRIEF DESCRIPTION OF THE DRAWING

The invention, both as to its construction and its manner of use, will be better understood by reference to the following disclosure and drawing forming a part thereof, wherein.

DESCRIPTION OF THE ILLUSTRATED EMBODIMENT

Figure 1:
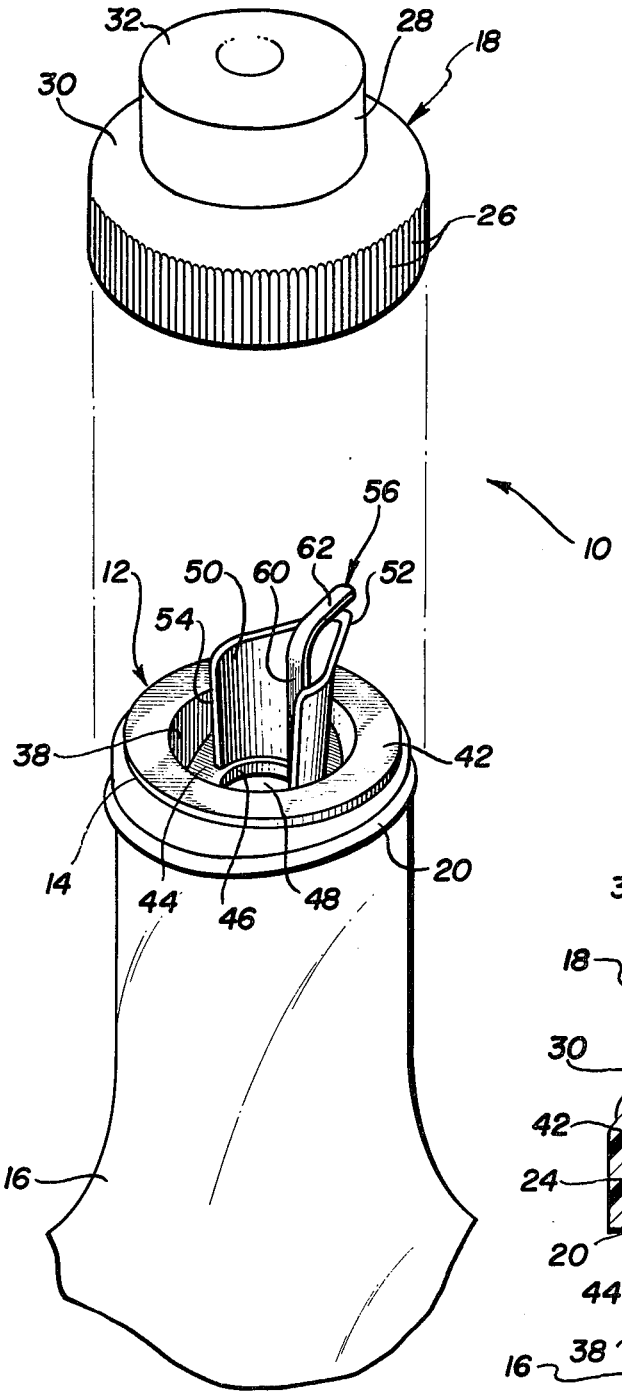
FIG. 1 is a perspective view of a dripless pouring spout and closure cap therefor constructed in compliance with the present invention, the pouring spout being shown in its use condition assembled to the mouth of a bottle and the closure cap being exploded away in disassembled condition.
Figure 2:
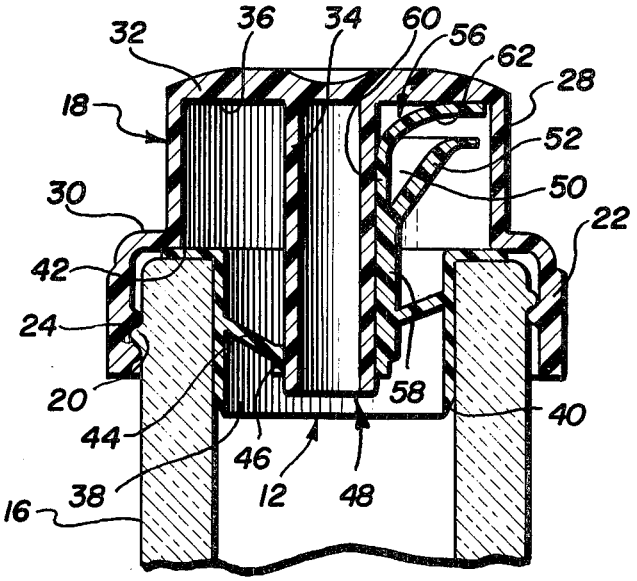
FIG. 2 is an enlarged, central cross-sectional view of the parts shown in FIG. 1 with the closure cap assembled to the bottle and to the pouring spout.

Referring now in detail to the drawing, specifically to FIGS. 1 and 2, a pouring spout combination illustrated generally by the reference numeral 10 includes a pouring spout member 12 which is arranged for assembly to the mouth 14 of a bottle 16 or other container, the spout combination 10 additionally including a closure cap member 18 which is arranged for assembly with the spout member 12. The cap member 18 is intended for interactive engagement with the pouring spout member 12, as will be described more fully hereinafter, and as a closure for the bottle 16 as well. The bottle 16 is accordingly provided with an external thread or rib 20 on the neck thereof adjacent the mouth 14; and the cap member 18 is fashioned with a pendant skirt 22 having internal threading 24 for cooperative engagement with the external bottle threads 20 as is shown in FIG. 2. In order to facilitate turning of the cap member 18 relative to the bottle 16 in the direction of either progressive engagement or disengagement with the threaded bottle neck, the skirt 22 is provided with vertical or other suitable, external knurling 26 in accordance with the showing of FIG. 1.

Continuing with particular reference to FIG. 2, the closure cap member 18 includes an upper cylindrical body 28 which is connected to the skirt 22 by an annular shoulder 30. In addition, a circular top plate spans the otherwise open upper end of the cylindrical body 28. The top plate 32 merges with a pendant, central, tubular stem 34 and defines a smooth annular internal surface 36 surrounding the stem 34, the stem 34 and the surface 36 coacting with components of the pouring spout member 12 in the manner described hereinafter.

Referring to FIG. 1 with secondary reference to FIG. 2, the pouring spout member 12 is fabricated with a cylindrical sleeve 38 which is arranged to fit inside the mouth of bottle 16 in a tightly fitting manner to secure the pouring spout and the bottle in assembled condition. Advantageously, the sleeve 38 is provided with a beveled lower edge 40 in order to lead the spout member into engagement with the bottle. An annular pad 42 extends radially outwardly from the sleeve 38 at its upper end to act as a downstop upon engagement with the lip of the bottle and additionally as a sealing ring for the inner surface of the shoulder 30 of closure cap member 18. A generally annular surface element or web 44 is disposed between the interior surface of sleeve 38 and a circular collar 46, the collar defining a generally central aperture 48 that serves as a pour and return opening.

In compliance with the present invention, a tubular spout 50 is connected to the web 44 in upstanding relationship to surround at least a portion of the periphery of the central aperture 48. The spout 50 is provided with a generally pyramidal, forwardly extending pouring lip member 52, and the spout 50 is longitudinally truncated to define a rearwardly facing opening 54 which promotes the flow of return liquids to the aperture 48. Advantageously, the web 44 is pitched downwardly toward the aperture 48, as is best seen in FIG. 2, in order to cooperate in this return of liquids to the bottle 16.

In further accord with the features of the present invention, an anti-drip finger 56 is disposed generally interiorly of the spout 50 to be interconnected therewith along a common section 58, generally forwardly of the spout and beneath the pouring lip member 52, as is best seen in FIG. 2. In its use position, the finger 56 comprises a vertically extending portion 60 and an angled, upper or tip portion 62 which overlies the pouring lip member 52 spaced apart therefrom in accordance with the showing of FIG. 2. So arranged, the tip portion 62 of finger 56 cooperates with the pouring lip member 52 to capture terminal droplets of poured liquid and return them to the central aperture 48 upon righting of the bottle 16 after pouring some of the contents therefrom. Upon re-seating of the closure cap member 18, progressive engagement of the cap threads 24 and the bottle thread 20 causes the stem 34 to penetrate completely through the collar element 46 to wipe residual liquid from the sides of aperture 48. This engagement of the stem and the collar also serves to center the cap member 18 with respect to the spout member 12.

Figure 3:
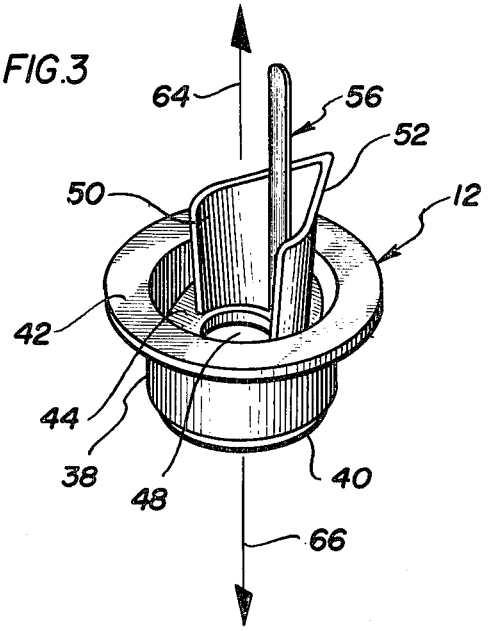
FIG. 3 is a perspective view of the pouring spout of FIG. 1 shown in the as-molded condition prior to assembly with the closure cap.

According to the present invention, the pouring spout member 12 is fabricated as a unitary part from a thermoplastic resinous material such as, for example, polyethylene, polypropelene or acrylonitrile-butadiene-styrene copolymers; and in order to facilitate injection molding of the part, the finger 56 is initially formed as a generally longitudinally extending, flat, blade-like element as is shown in FIG. 3. Thus, the mold parting plane may be located at the edge of pad 42 and the cooperative elements of the mold or die may be separated in the respective directions of arrows 64 and 66 to release the finished part without the pulling of complicated cores. In addition, the tip portion 62 is arranged to be bendable and to be of substantially permanently deformable material so that, for example, after the bottle 16 has been filled and the spout member 12 assembled to the mouth thereof, the turning of closure cap member 18 will result in engagement of the surface 36 and the tip portion 62 to deform or "set" the tip portion into its use position shown in FIG. 2. The permanently deformable nature of the finger 56 prevents the tip portion 62 from returning to its initial, upright position aligned with the vertical portion 60 upon removal of the closure cap member 18.

It will be apparent from the foregoing descriptions that there has been provided a combination dripless pouring spout and closure cap that is of particular advantage in both use and manufacture. The drawings and the foregoing descriptions are therefore not intended to represent the only forms of the invention in regard to the details of its construction and manner of use. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. A combination dripless pouring spout and closure cap therefore comprising: a one-piece pouring spout member molded from thermoplastic resinous material and arranged for assembly to the mouth of a container, said pouring spout member including surface means defining a generally central aperture, a tubular spout upstanding from said surface means about at least a portion of the periphery of said aperture, and an initially, as-molded longitudinally extending, anti-drip finger disposed generally inside said spout and having a bendable tip portion of substantially permanently deformable character arranged to be bent into position overlying the upper lip of said spout and spaced therefrom; and a closure cap member arranged for assembly with said spout member and including transverse top plate means for permanently deformably engaging the tip portion of said finger upon mounting said closure cap member on said pouring spout member, said anti-drip finger being initially a flat, blade-like element.

* * * * *